US005848953A

United States Patent [19]

Wei et al.

[11] Patent Number: 5,848,953

[45] Date of Patent: Dec. 15, 1998

[54] WHEEL-TYPE RESISTANCE DEVICE FOR A BICYCLE EXERCISER

[76] Inventors: Mike Wei, No. 229, Lane 75, Sec. 3, Kang-Ning Rd., Nei-Hu Dist., Taipei; Sheng-Jung Wu, No. 64, Alley 60, Lane 632, Sec. 3, Chang-Hsin Rd., Ho-Mei Chen, Chang-Hua Hsien, both of Taiwan

[21] Appl. No.: 89,854

[22] Filed: Jun. 3, 1998

[51] Int. Cl.[6] ..... A63B 22/06; B60L 7/00

[52] U.S. Cl. ..... 482/63; 188/164

[58] Field of Search ..... 482/57, 63, 903, 482/5.6; 188/164, 161, 163, 267; 310/93, 105, 153; 123/697

[56] References Cited

U.S. PATENT DOCUMENTS

| | | | |
|---|---|---|---|
| 4,146,806 | 3/1979 | Katsumata | 310/153 |
| 4,550,697 | 11/1985 | Campen | 123/149 D |
| 5,072,930 | 12/1991 | Sun | 482/63 |
| 5,236,069 | 8/1993 | Peng | 482/63 |
| 5,247,854 | 9/1993 | Wu | 482/63 |
| 5,586,624 | 12/1996 | Ko et al. | 482/63 |

*Primary Examiner*—Stephen R. Crow

*Attorney, Agent, or Firm*—Christensen O'Connor Johnson & Kindness PLLC

[57] ABSTRACT

A wheel-type resistance device includes a flywheel rotated with a hub member around an axle and having an accommodation chamber with a first circumferential portion which is provided with a magnetically attractive member. A dragging force adjusting member is mounted on the axle and has a second circumferential portion registered with the first circumferential portion. Upper and lower magnetic members are disposed movably on the second circumferential portion and are spaced apart from and are in symmetry with each other relative to a horizontal line transverse to an axial direction defined by the axle. Linear movement of the upper and lower magnetic members toward the horizontal line along a transverse direction relative to the horizontal line is actuated by an actuating member so as to decrease the extent of overlapping of the upper and lower magnetic members with the second circumferential portion. In addition, keyways are disposed on the dragging force adjusting member and extend in the transverse direction for receiving and guiding keys formed on the upper and lower magnetic members to assure the linear movement for generating an even magnetic dragging force. A biasing member is provided to bias the upper and lower magnetic members against the linear movement.

10 Claims, 6 Drawing Sheets

WHEEL-TYPE RESISTANCE DEVICE FOR A BICYCLE EXERCISER

BACKGROUND OF THE INVENTION

1. Field of the Invention

This invention relates to a resistance device for a bicycle exerciser, more particularly to a wheel-type resistance device which can provide an even magnetic resisting force between a flywheel and a dragging force adjusting member thereof.

2. Description of the Related Art

Referring to FIGS. 1 and 2, a conventional wheel-type resistance device for a bicycle exerciser includes a flywheel 2 which is sleeved rotatably on an axle 1. The flywheel 2 has an accommodation chamber 2*a* which is indented axially to form an inner peripheral wall around the axle 1 on which two magnetically permeable members 3 are secured angularly. A dragging force adjusting member 4 is received in the chamber 2*a*, and includes a plate member 5 with an annular groove 5*a* at its outer periphery. An elongate sliding slot 5*d* extends radially and inwardly from the annular groove 5*a*. Two connecting holes 5*b* are formed diametrically opposite to the sliding slot 5*d* relative to the axle 1 for mounting slidably a sliding seat 7. Two mounting holes 5*e* extend radially and inwardly from the annular groove 5*a* at opposite sides of the sliding slot 5*d* to receive respectively two springs 5*f*. Each of two fastening plates 6 has a first end pivoted to the respective connecting hole 5*b*, and a second end extending adjacent to the sliding slot 5*d* to connect with a guiding cord 8 which in turn is connected to the sliding seat 7 via a pulley 5*c*. Each fastening plate 6 has an outer peripheral wall which is provided with two magnets 9,9' thereon opposite to the magnetically permeable members 3, and an inner peripheral wall which is biased by the respective spring 5*f*. When the flywheel 2 is rotated relative to the adjusting member 4, the magnets 9,9' are drawn by the magnetically permeable members 3 to generate a magnetic dragging force.

A cable 7*a*, which is connected to the sliding seat 7, is pulled to move the sliding seat 7 along the sliding slot 5*d* so as to swing the second ends of the fastening plates 6 relative to the first ends. As such, the fastening plates 6 are moved radially and inwardly so as to move the magnets 9,9' away from the magnetically permeable members 3 to decrease the magnetic dragging force therebetween. The springs 5*f* bias the fastening plates 6 toward the flywheel 2 against the action of the cable 7*a*.

The drawbacks of the conventional resistance device are as follows:

1. The clearance between the magnet 9 and the opposing magnetically permeable member 3 is larger than that between the magnet 9' and the opposing magnetically permeable member 3 when the second ends of the fastening plates 6 are drawn relative to the first ends to move the magnets 9,9' away from the flywheel 2, thereby resulting in an uneven magnetic dragging force.
2. Each of the magnetically permeable members 3 and the fastening plates 6 is bent to be semi-circular in shape, thereby resulting in increased difficulties during manufacture and assembly.

SUMMARY OF THE INVENTION

The object of the present invention is to provide a wheel-type resistance device that can provide an even magnetic resisting force and that is relatively easy to manufacture and assemble.

According to this invention, a wheel-type resistance device includes a flywheel rotated with a hub member around an axle and having an accommodation chamber with a first circumferential portion which is provided with an angular magnetically attractive member. A dragging force adjusting member is mounted on the axle and has a second circumferential portion registered with the first circumferential portion. Upper and lower magnetic members are disposed movably on the second circumferential portion and are spaced apart from and are in symmetry with each other relative to a horizontal line transverse to an axial direction defined by the axle. The linear movement of the upper and lower magnetic members toward the horizontal line along a transverse direction relative to the horizontal line is actuated by an actuating member so as to decrease the extent of overlapping of the upper and lower magnetic members with the second circumferential portion. In addition, keyways are disposed on the dragging force adjusting member and extend in the transverse direction for receiving and guiding keys formed on the upper and lower magnetic members to assure the linear movement. A biasing member is provided to bias the upper and lower magnetic members against the linear movement.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
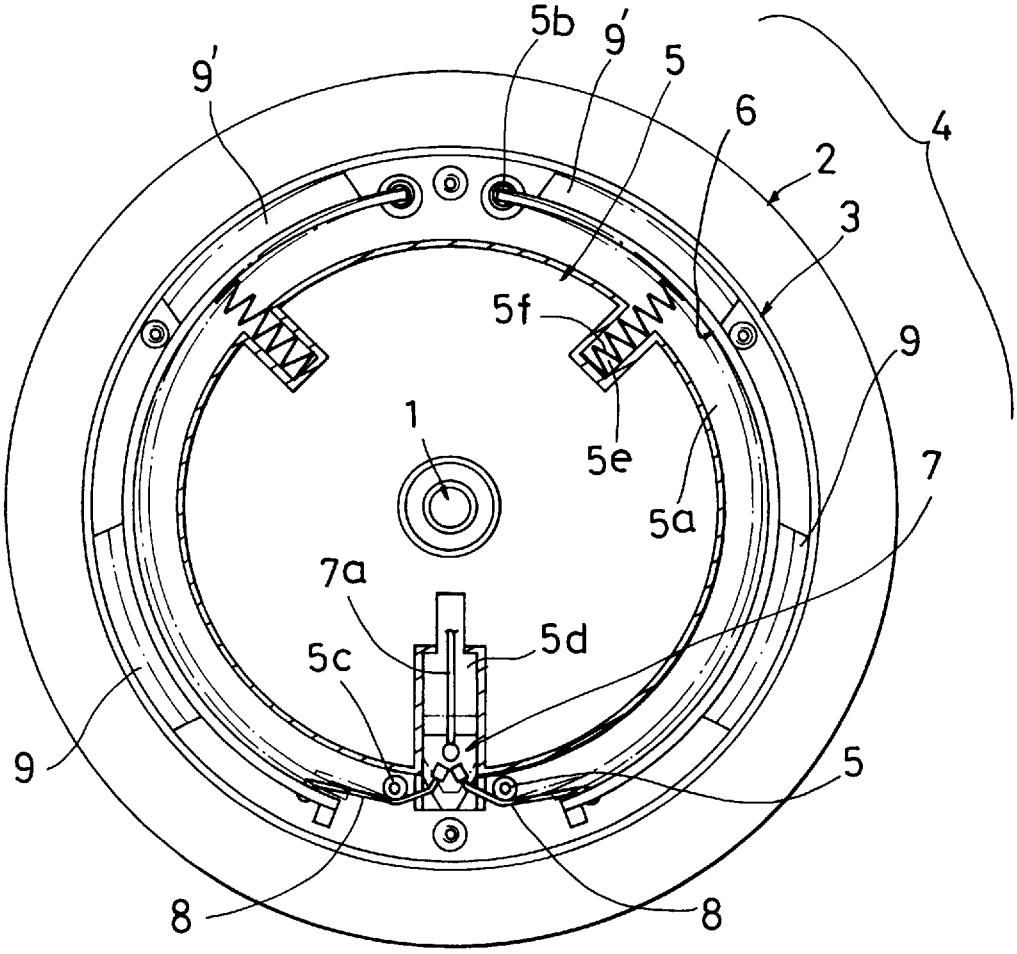
FIG. 1 PRIOR ART
FIG. 1 is a front sectional view of a conventional wheel-type resistance device for a bicycle exerciser.
Figure 2:
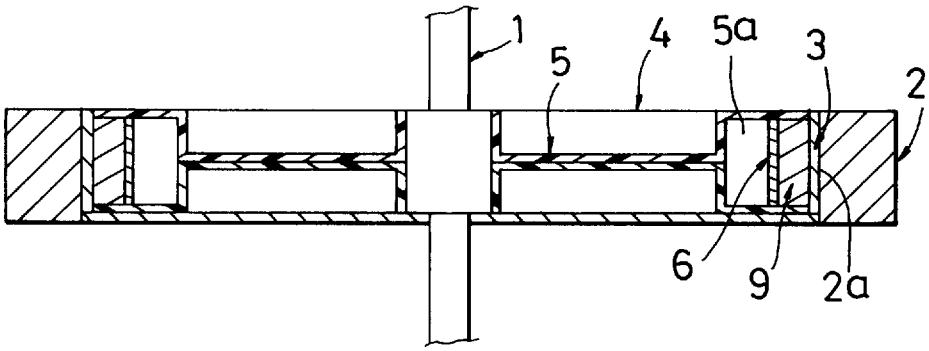
FIG. 2 PRIOR ART
FIG. 2 is a sectional side view of the conventional resistance device.
Figure 3:
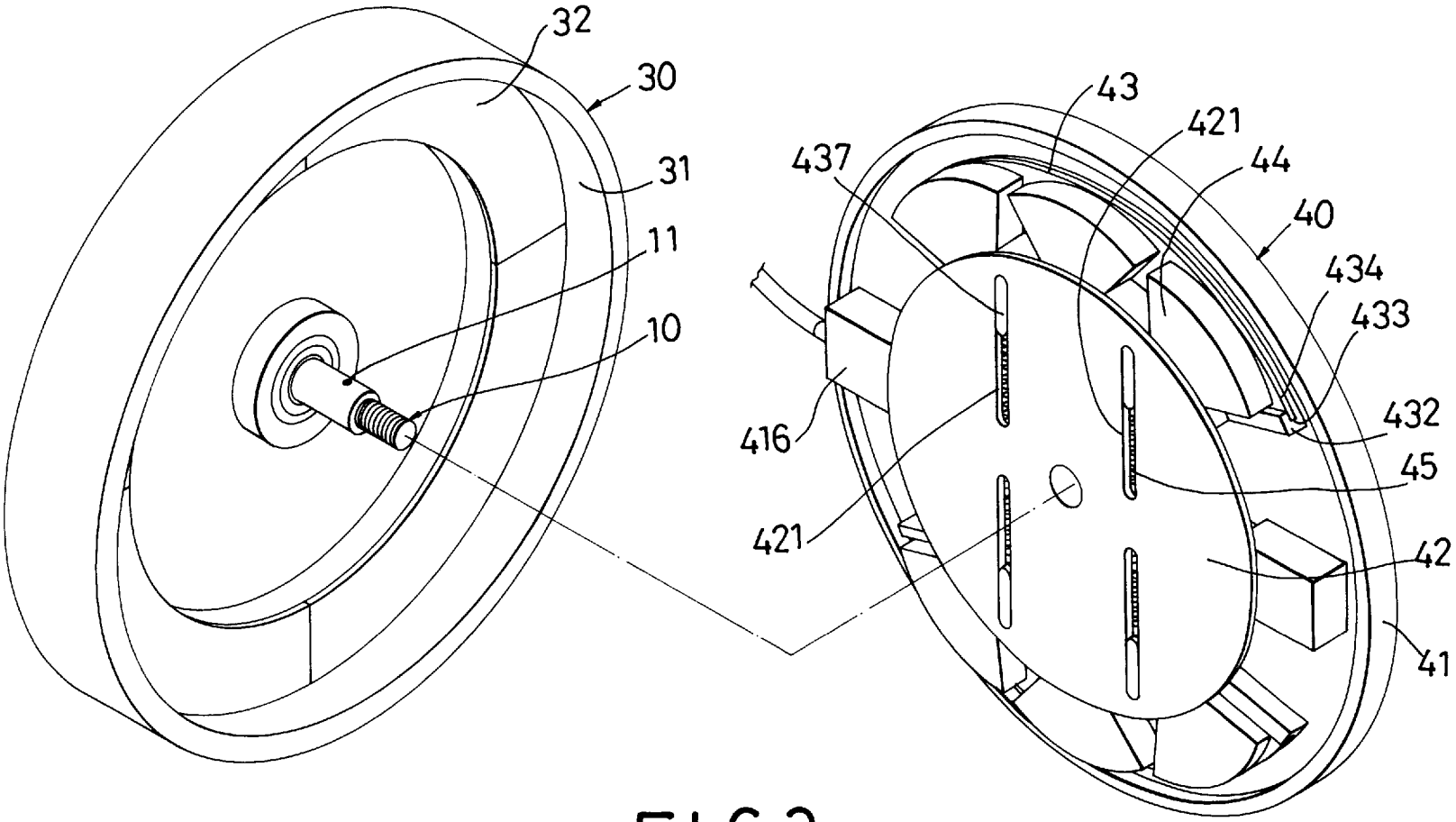
FIG. 3 is an exploded view of a preferred embodiment of a wheel-type resistance device according to this invention.
Figure 4:
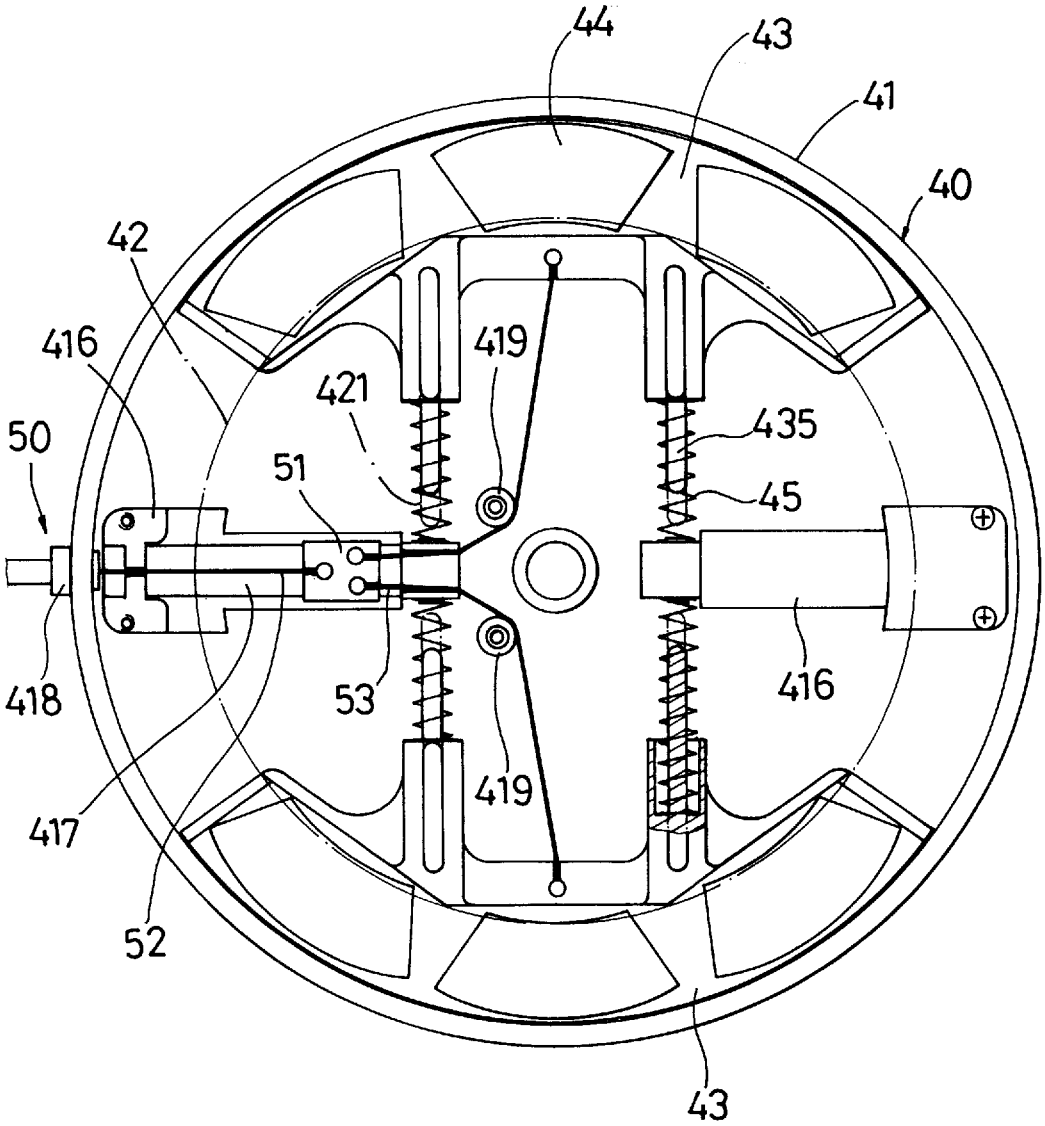
FIG. 4 is a front view of the preferred embodiment.
Figure 5:
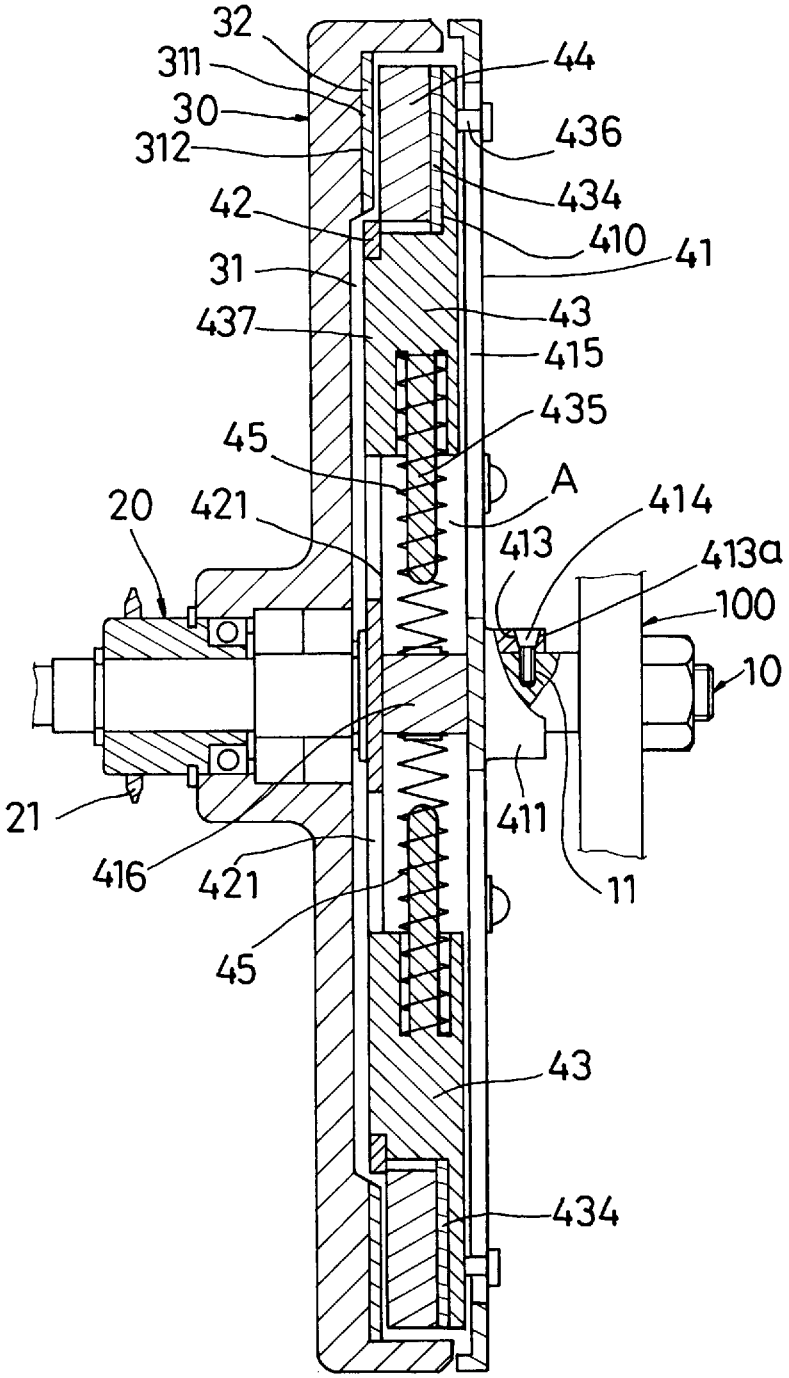
FIG. 5 is a sectional side view of the preferred embodiment.

Referring to FIGS. 3, 4 and 5, the preferred embodiment of a wheel-type resistance device according to the present invention is shown to be mounted on axle 10 which is secured on a bicycle exerciser frame 100. The axle 10 has two screw holes 11 which are formed radially therein. The resistance device is shown to comprise a flywheel 30, a dragging force adjusting member 40, upper and lower magnetic members, a circular guiding plate 42, a plurality of compression springs 45, and an actuating member 50.

The flywheel 30 is made of a magnetically attractive material, such as iron, and is mounted rotatably on the axle 10 for rotation together with a hub member 20 via a chain wheel 21 which is driven to rotate by a pedaling action of a user (this is known in the prior art). The flywheel 30 has a left end wall proximate to the hub member 20, and a right end wall with an accommodation chamber 31 indented axially and leftward so as to form a dragging force generating wall which is spaced apart from the right end wall and which has a first circumferential portion 311 extending in a radial direction relative to the axle 10. An angular magnetically attractive member 312 is formed on the first circumferential portion 311. Four arcuate magnetically permeable members 32, which are made of aluminum, are disposed on the magnetically attractive member 312.

The dragging force adjusting member 40 includes a circular plate body 41 which is made of a plastic material and which is mounted on the axle 10. The plate body 41 has a right major surface and a left major surface which is spaced apart from and opposing the dragging force generating wall of the flywheel 30 and which is provided with a second circumferential portion 410 that is registered with the first circumferential portion 311. A sleeve 411 is formed on the plate body 41 around the axle 10 and has two through holes 413 which are formed therethrough and which have wider openings 413*a*. Two countersunk bolts 414 are inserted into the through holes 413 and the screw holes 11 of the axle 10 in order to fasten the plate body 41 on the axle 10. Two first elongate grooves 415 are formed in the plate body 41 and are spaced apart from and are disposed parallel to each other in a transverse direction to serve as first keyways. A horizontal protrusion 416 projects leftward from the plate body 41 and extends transverse to the axial direction of the axle 10.

The guiding plate 42 is made of a plastic material, and has a diameter smaller than that of the plate body 41. The guiding plate 42 is secured on the horizontal protrusion 416 so as to confine a receiving space (A) with the plate body 41. Two second elongate grooves 421 are formed in the guiding plate 42 and are spaced apart from and are disposed parallel to each other in a transverse direction to serve as second keyways.

The upper and lower magnetic members are disposed movably in the receiving space (A), and include arcuate upper and lower mounting members 43 which define respectively upper and lower magnetic zones with upper and lower leading and tailing ends 432, respectively. The upper leading and tailing ends 432 are diametrically opposite to the lower tailing and leading ends 432, respectively, so that the upper and lower mounting members 43 are spaced apart from and in symmetry with each other relative to the horizontal protrusion 416. Each of the upper and lower mounting members 43 has right and left surfaces opposing respectively the plate body 41 and the first circumferential portion 311 of the flywheel 30. Two pairs of projecting members 436, 437 serve as keys and project respectively from the right and left surfaces equidistant to the middle line which passes through the axis of the axle 10 and which is disposed between the leading and tailing ends 432 so as to be inserted into and guided by the first and second elongate grooves 415,421.

Figure 6:
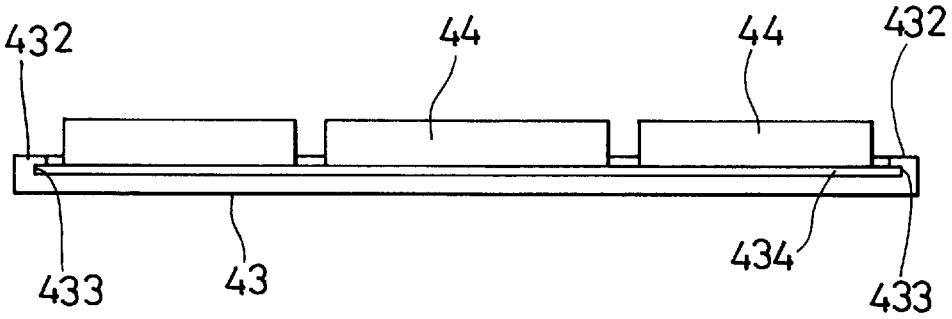
FIG. 6 is a schematic view showing how magnets are mounted on a dragging force adjusting member of the preferred embodiment.

With reference to FIG. 6, each of the leading and tailing ends 432 projects from the mounting member 43 to form an engaging cavity 433 so as to engage an anchoring member 434 which is made of a magnetically attractive material to assist in the mounting of a plurality of arcuate magnets 44 onto the mounting member 43. The magnets 44 are opposite to the magnetically permeable members 32.

In addition, each of the mounting members 43 has two projecting portions 435 which extend toward the horizontal protrusion 416 for mounting the compression springs 45 thereon. Each of the springs 45 is biased against the horizontal protrusion 416.

The actuating member 50 includes a sliding rail 417 which is disposed in and which extends along the horizontal protrusion 416, a tube member 418 which is provided on the plate body 41, and a sliding seat 51 which is mounted slidably on the sliding rail 417. Two connecting cords 53 have first ends which are connected respectively to the upper and lower mounting members 43 at the middle line, and second ends which engage the sliding seat 51 and which are trained on guiding pulleys 419 that are mounted on the plate body 41. A cable 52 has a fixed end connected to the sliding seat 51, and a free end adapted to be mounted on an actuating switch (not shown) of the bicycle exerciser (not shown) via the tube member 418.

In the state of the resistance device shown in FIG. 4, the overlapping area of the magnets 44 with the magnetically attractive member 312 is largest. When the chain wheel 21 drives the flywheel 30 to rotate, the magnetic forces of the magnets 44 permeate through the magnetically permeable members 32 to provide a largest magnetic dragging force to the flywheel 30. As such, a larger pedaling force must be applied to counter the dragging force, thereby achieving an exercising effect.

Figure 7:
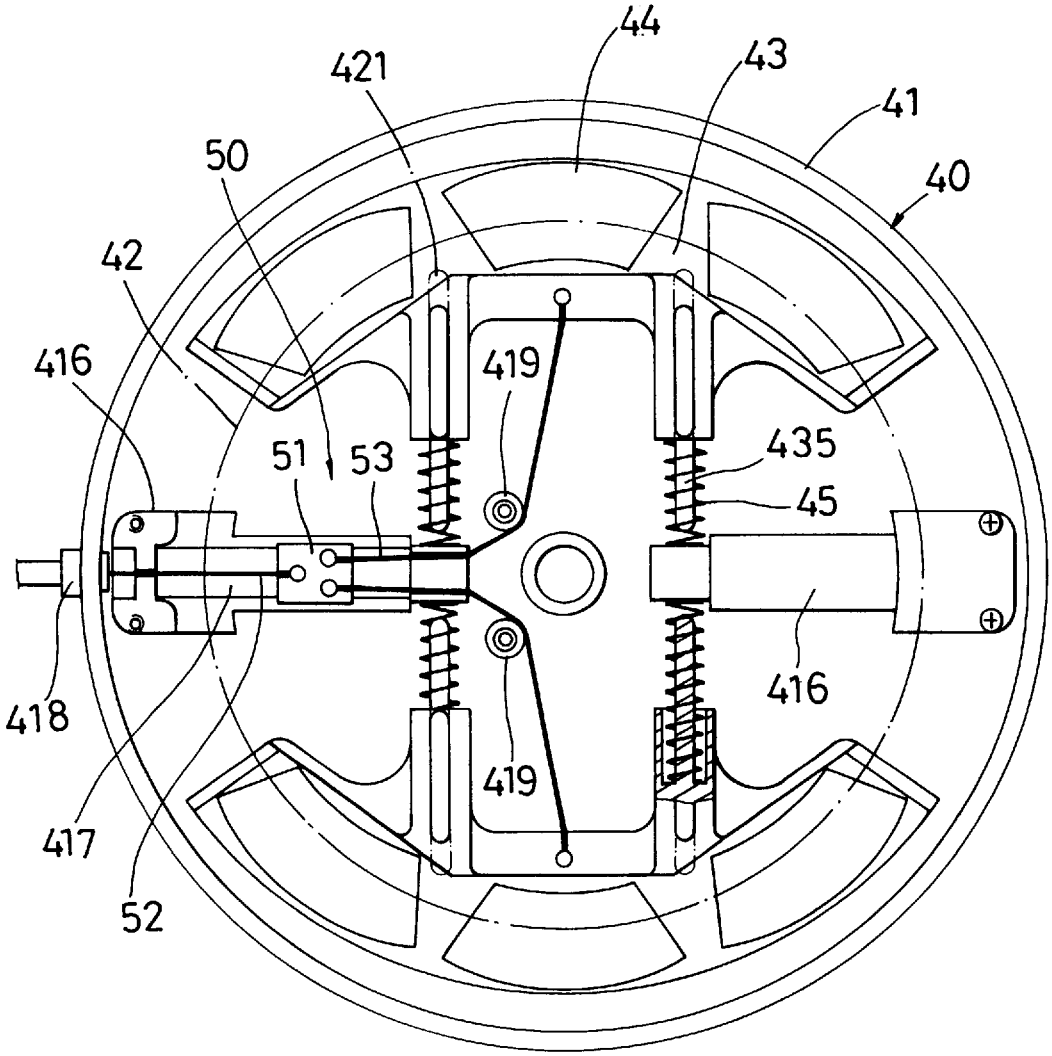
FIG. 7 is a front view of the preferred embodiment in an adjusted state.

Referring to FIG. 7, when the cable 52 is pulled by turning the actuating switch (not shown) to move the sliding seat 51 along the sliding rail 417, the upper and lower mounting members 43 are moved linearly toward the horizontal protrusion 416 along the transverse direction by the guidance of the elongate grooves 415,421 and the projecting members 436,437. As such, the overlapping area is decreased so that the magnetic dragging force can be correspondingly decreased to accommodate a variety of exercising requirements. In this state, the compression springs 45 are compressed. When it is desired to increase the magnetic dragging force, the actuating switch is turned so that the upper and lower mounting members 43 can slide away from the horizontal protrusion 416 with assistance of the springs 45.

As illustrated, even linear movements of the upper and lower mounting members 43 in the transverse direction are ensured by the guidance of the elongate grooves 415,421 and the projecting members 436,437 so that the opposing distances between the magnets 44 and the corresponding magnetically permeable members 32 are equal, thereby generating an even magnetic dragging force. In addition, each of the magnetically permeable members 32 is shaped a flat plate, thereby simplifying the manufacture and assembly thereof.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A wheel-type resistance device for providing a resisting force to a bicycle exerciser which includes an axle defining an axial direction, and a hub member mounted rotatably on the axle and driven to rotate by a pedaling action of a user, said wheel-type resistance device comprising:

a flywheel having left and right end walls, said flywheel being adapted to be mounted rotatably on the axle such that said left end wall is proximate to and is rotated together with the hub member around the axle, and such that said right end wall is distal to the hub member, said right end wall having an accommodation chamber therein indented axially and leftward so as to form a dragging force generating wall which is spaced apart from said right end wall in the axial direction and which has a first circumferential portion extending in a radial direction relative to the axle;

an angular magnetically attractive member disposed on said first circumferential portion;

a dragging force adjusting member adapted to be mounted on the axle and having a right major surface and a left major surface which is spaced apart from and opposing said dragging force generating wall and which is provided with a second circumferential portion that is registered with said first circumferential portion;

upper and lower magnetic members disposed movably on said second circumferential portion and spaced apart from and in symmetry with each other relative to a horizontal line transverse to the axial direction;

an actuating member connected to said upper and lower magnetic members for actuating linear movement of said upper and lower magnetic members toward the horizontal line along a transverse direction relative to the horizontal line so as to decrease extent of overlapping of said upper and lower magnetic members with said second circumferential portion;

at least one first keyway disposed on said dragging force adjusting member and extending in the transverse direction toward the horizontal line;

at least one first key disposed on each of said upper and lower magnetic members and inserted into and guided by said first keyway to assure the linear movement of said upper and lower magnetic members; and means for biasing said upper and lower magnetic members to increase the extent of overlapping thereof with said second circumferential portion against action of said actuating member.

2. The wheel-type resistance device according to claim 1, wherein each of said upper and lower magnetic members has a right surface opposing said dragging force adjusting member, and a left surface opposing said flywheel, said first key projecting from said right surface.

3. The wheel-type resistance device according to claim 2, further comprising a guiding plate mounted securely to said dragging force adjusting member between said left surfaces of said upper and lower magnetic members and said right end wall of said flywheel for guiding the linear movement of said upper and lower magnetic members.

4. The wheel-type resistance device according to claim 3, further comprising:

at least one second keyway disposed on said guiding plate and extending in the transverse direction; and at least one second key projecting from said left surface of each of said upper and lower magnetic members toward said guiding plate so as to be inserted into and guided by said second keyway.

5. The wheel-type resistance device according to claim 1, wherein each of said upper and lower magnetic members includes a mounting member disposed movably on said second circumferential portion, and a plurality of magnets secured on said mounting member.

6. The wheel-type resistance device according to claim 5, wherein each of said upper and lower magnetic members further includes an anchoring member made of a magnetically attractive material and mounted between said mounting member and said magnets for attracting said magnets thereon so as to assist in mounting of said magnets onto said mounting member.

7. The wheel-type resistance device according to claim 1, wherein said biasing means includes at least one compression spring having two ends connected respectively to said upper and lower magnetic members so as to bias against the linear movement toward the horizontal line of said upper and lower magnetic members.

8. The wheel-type resistance device according to claim 1, wherein said actuating means includes a sliding rail formed on said dragging force adjusting member and disposed parallel to the horizontal line, a sliding seat mounted slidably on said sliding rail, two connecting cords having first ends connected respectively to said upper and lower magnetic members and second ends engaging said sliding seat, and a cable having a fixed end connected to said sliding seat and a free end adapted to be mounted on the bicycle exerciser and operable so as to pull said upper and lower magnetic members.

9. The wheel-type resistance device according to claim 8, wherein said actuating means further includes two guiding pulleys mounted on said dragging force adjusting member for training said connecting cords thereon.

10. The wheel-type resistance device according to claim 1, further comprising a plurality of magnetically permeable members disposed on said magnetically attractive member.

* * * * *